United States Patent [19]

Rowell

[11] Patent Number: 5,003,858

[45] Date of Patent: Apr. 2, 1991

[54] PORTABLE RESONATING PLATFORM AND T-BAR FOR SECURING THE ENDPIN AND ENHANCING THE TONE OF A CELLO

[76] Inventor: Frances E. Rowell, P.O. Box 185, Limeport, Pa. 18060

[21] Appl. No.: 437,362

[22] Filed: Nov. 15, 1989

[51] Int. Cl.[5] ..... G10D 3/02

[52] U.S. Cl. ..... 84/280

[58] Field of Search ..... 84/280

[56] References Cited

U.S. PATENT DOCUMENTS 4,018,129 4/1977 Hollander ..... 84/280 C

FOREIGN PATENT DOCUMENTS 38302 8/1909 Austria ..... 84/280 C

OTHER PUBLICATIONS

Advertisement for "Cello Resonator", Strings, Sept./Oct., p. 17 (1989).

Catalog Description of "Endpin Rests", Concord Musical Supplies, P.O. Box 916, Maywood, N.J., 07607, pp. 30-31 (1989).

*Primary Examiner*—Lawrence R. Franklin

*Attorney, Agent, or Firm*—Brumbaugh, Graves Donohue & Raymond

[57] ABSTRACT

A portable resonating platform for enhancing the tone of a cello comprises an upper plate and a lower plate rigidly joined in spaced-apart relation. The upper plate has a groove extending laterally along the top surface in which the endpin of the cello can be received in any desired position along the length of the groove. The platform is connected to the cellist's chair by a T-bar structure to prevent the platform from slipping during use. The cellist can adjust the position of the platform relative to the chair, which, in conjunction with placement of the endpin of the cello along different positions within the groove, allows the highest degree of comfort possible.

8 Claims, 2 Drawing Sheets

PORTABLE RESONATING PLATFORM AND T-BAR FOR SECURING THE ENDPIN AND ENHANCING THE TONE OF A CELLO

BACKGROUND OF THE INVENTION

This invention relates to providing a portable platform that secures the endpin and enhances the sound of a cello. More particularly, the invention relates to a portable resonating platform for variably enhancing the tone of a cello and for allowing the instrumentalist to adjust the cello into more comfortable positions during playing. The present invention also relates to a system for securing the portable platform into a particular position relative to the instrumentalist's chair such that the platform does not slide along the floor while the cello is being played.

Conventionally, platforms for playing the cello are full-size podiums large enough to accommodate both the cellist and the cello. Open fronts on such podiums proved to add a resonance to the cello's sound. Smaller resonating devices are typically made of two plates of wood separated by a space. The top plate contains a hole for receiving the endpin of a cello, and the bottom plate rests on a non-skid substance such as rubber or sand paper which helps prevent the device from sliding across the floor while the cello is being played. A cellist typically sits on a chair with the device positioned between his or her feet and with the endpin of the cello inserted within the hole during playing of the instrument. On some devices, to prevent sliding while the endpin is within the hole, a string or light rope is wrapped around dowels that separate the plates. The ends of the string are fixed together to form a loop which extends from between the two plates. The string is placed around the front legs of the chair used by the cellist to position the device more securely.

There are several drawbacks to such devices which have prevented their widespread use. Devices which are not attached to the player's chair can slide forward due to the substantial forward force of the cello endpin exerted on them. Devices attached by ropes tied to the chair prevent forward slippage but do not provide lateral stability. The string or light rope can only prevent the platform from sliding forward; the platform can slide from side to side or on an arc sideways and backwards towards the chair. If the cellist shifts position, the devices tend to skid across the floor. Any slight change in pressure on the cello may cause the platform to move back toward the chair or in the direction perpendicular from the axis running from the platform towards the chair, resulting in discomfort for the player and possible disruption of playing. The rubber feet in combination with the rope or string are not effective against a sudden change in force applied to the instrument. The tone of the cello suffers greatly when the performer does not feel comfortable with the instrument due to the fear that the endpin might slip at any moment.

Previous devices have a single hole for the endpin. Should the cellist desire to move the cello into various positions, for instance to more easily play certain difficult to reach notes, the endpin can be removed from the hole and placed at a different position along the top of the plate. However, when the endpin of the cello is removed from the hole and placed on the top of the platform, it is no longer secure. To move the cello into different positions relative to the cellists chair the entire device may be moved into different positions by adjusting the length of the rope. However, this does not allow the performer to make small adjustments while actually playing. To make an adjustment, the cello needs to be put down as the player needs both hands to adjust the rope. The cello is thus effectively at a fixed position, which does not accommodate individual styles of holding the cello. Since the cellist is compelled to maintain the endpin of the cello within the hole, he or she is not able to move the cello into different and more comfortable positions, thereby adversely affecting the player's comfort, which in turn affects the quality of the sound.

Previous devices have not taken into account the quality of the sound enhanced by the device, a drawback since cellos vary widely in their sound quality. As a consequence many cellos do not respond well to the tonal enhancement provided by prior art devices; indeed the sound quality can actually be diminished.

SUMMARY OF THE INVENTION

The present invention avoids the foregoing problems of the previously known devices and provides a portable resonating platform for enhancing the tone of a cello which allows the endpin of the cello to be placed in a variety of different positions on the platform, even while playing. The cellist does not have to worry that the position of the portable platform will change as the cello endpin is moved, because the endpin moves along a groove, thus allowing for flexibility in play without a reduction in quality of tone enhancement. The present invention also provides platforms which cause the sound of a cello to resonate sound differently, thus providing tone enhancement for a wide variety of cellos.

In accordance with the invention a portable resonating platform for enhancing the tone of a cello includes a lower wooden plate, an upper wooden plate with a transverse groove in its upper surface, and rigidly joined to the lower wooden plate in spaced-apart relation, and means for preventing the plates from sliding when positioned on a surface. The groove of the upper wooden plate is capable of receiving the endpin of a cello in any position along its length, thereby allowing the cellist to move the endpin laterally along the groove to achieve a more desirable balance between player and cello.

The means for preventing the plates from sliding preferably includes slip resistant bumpers mounted along the underside of the lower plate and an adjustable T-bar structure for connecting the plates to the player's chair. The T-bar structure includes a first and second member joined at right angles. The first member is capable of being adjustably connected to the lower plate of the portable platform and the second member has a notch sized to coincide with the first member in a substantially perpendicular position. The second member is mountable behind the legs of a chair to prevent the portable platform from slipping.

The variable resonance of the platform is provided by the use of different woods in the upper plate. The wood grain density has been found to correlate with the degree of resonance provided.

DESCRIPTION OF THE PREFERRED EMBODIMENT

Figure 1:
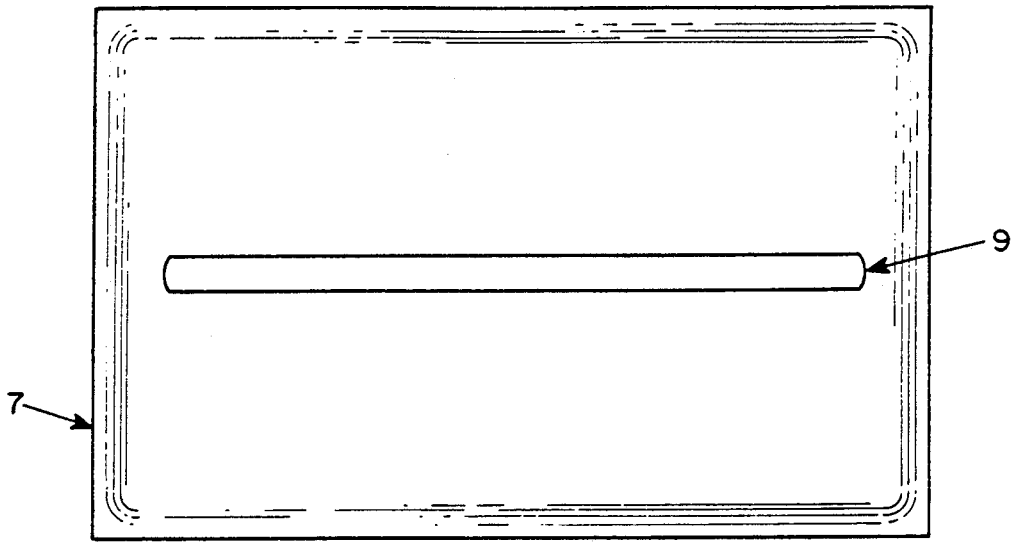
FIG. 1 is a top view of the exemplary embodiment of the portable platform according to the present invention.
Figure 2:
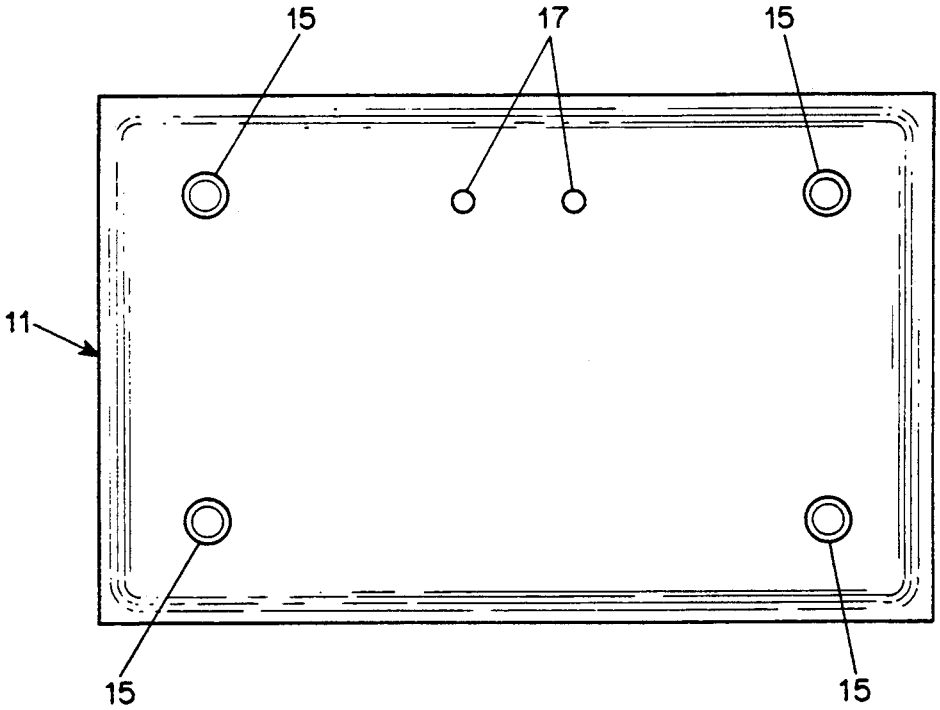
FIG. 2 is a bottom view of the exemplary embodiment depicted in FIG. 1.
Figure 3:
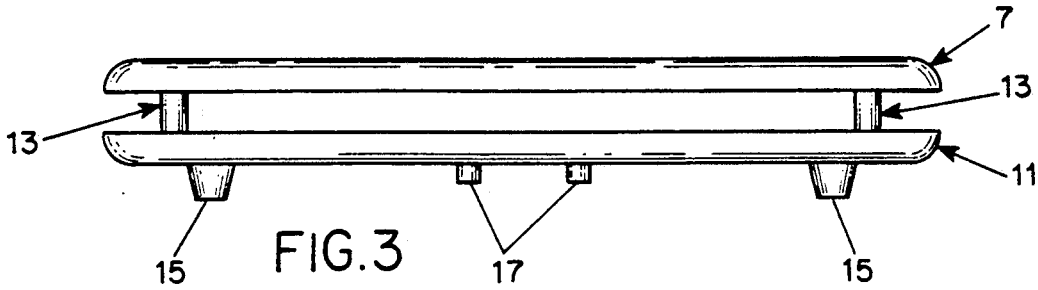
FIG. 3 is a side elevational view of the side that faces the cellist of the exemplary embodiment depicted in FIG. 1.

Referring to FIGS. 1 to 3, a portable resonating platform for enhancing the tone of a cello, according to the preferred embodiment (T-bar structure not shown), includes an upper wooden plate 7 with a groove 9 along its upper surface (FIG. 1). The lower surface of the lower plate 11 (FIG. 2) has anti-slip rubber feet 15 that rest on the floor to prevent slipping and a pair of mounting dowels 17 that protrude from the lower surface of the lower plate 11. The upper and lower plates 7 and 11 are joined in spaced-apart relation by wooden dowels 13 inserted and glued in holes in the lower surface of the upper plate 7 and the upper surface of the lower plate 11.

Preferably, both plates 7 and 11 are five inches in width by eight inches in length. Each of the plates 7 and 11 should be approximately three-quarters of an inch thick. The edges of the plates 7 and 11 may be beveled or rounded for good appearance and to prevent any sharp edges that could splinter.

The groove 9 in the upper plate 7 is a half-inch wide and a quarter-inch deep, runs in the longer direction, and is easily made by cutting with a quarter-inch deep router or a dado blade. The groove 9 is placed approximately in the width-wise a little off the width-wise center, e.g., about two and one-eighth inches from the side of the plate 7 furthest from the cellists chair and two and three-eighth inches from the side of the plate 7 closest to the chair. Although these distances are preferred they can be altered and adjusted to suit a particular cellist's style of play. The preferred slight asymmetric placement of groove 9 contributes to the stability of the platform. Preferably, the groove 9 does not extend throughout the entire length of the upper plate so that the endpin of the cello will not be moved out of the groove while the cello is being played.

The wooden dowels 13 used for connecting and spacing the upper and lower plates 7 and 11 should be approximately one inch in length to provide a one-half inch space between the plates 7 and 11 after being set into holes one quarter-inch deep in each plate.

The mounting dowels 17 are preferably placed on the underside of the lower plate 11 towards the side of the plate closest to the chair. This preferred placement tends to increase stability of the platform, however, it can be altered to suit a particular cellists style of playing.

The anti-slip rubber feet 15 should be at least one-half inch in height to provide for a space between the lower surface of the lower plate and the floor to allow for the T-bar structure to fit between the floor and the lower plate. Preferably, four anti-slip rubber feet, one near each corner, should be used for optimum stability and resistance against slippage.

It has been found that the type of wood of which the upper plate 7 is made brings out different tonal qualities of a cello. Thus, by using different woods for the upper plate 7 the resonating platform is able to compensate for a variety of inadequacies in cello tones. Upper plates 7 made of more tightly grained woods tend to focus the sound, upper plates 7 made of more loosely grained woods tend to diffuse the sound. For example, an upper plate 7 made of plain maple and a lower plate 11 made of spruce can facilitate a wide freely vibrating sound which can preferably be used with cellos which have a constrained or tight tone. An upper plate 7 of flamed maple and a lower plate 11 of even grained spruce provide cellos which sound unfocused or loose with a more focused, tighter vibrating sound.

Figure 4A:
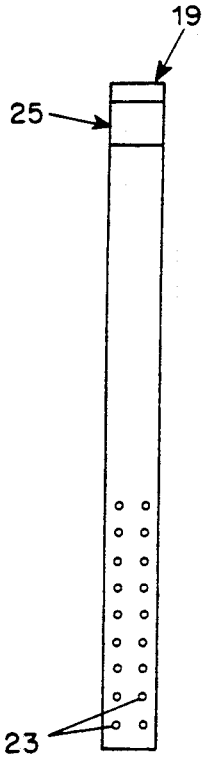
FIGS. 4A and 4B are top and side views of the first member of the T-bar structure, respectively.
Figure 4B:
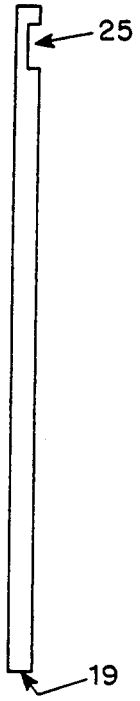
Figure 5A:
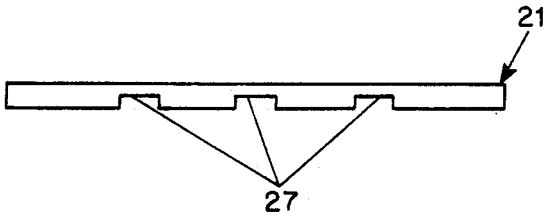
FIGS. 5A and 5B are side and bottom views of the second member of the T-bar structure, respectively.
Figure 5B:
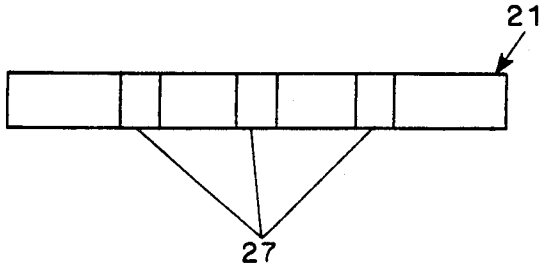

The adjustable T-bar structure is provided by a first member 19, shown in FIG. 4 (A and B) which, when in place, extends outwardly from the front of a cellists chair and a second member 21 shown in FIG. 5 (A and B) that, when in place, is positioned behind the two front legs of the cellists chair. The first member 19 is preferably two inches wide, twenty-eight inches long and one-half inch thick. Several pairs of longitudinally spaced-apart holes 23 are made in the top of the first member 19, starting near the end furthest from the cellists chair and continuing partway toward the end closest to the cellists chair, thereby resulting in pairs of holes 23 spaced at different lengths from the ends of the first member 19. The pairs of holes 23 may be equidistant length-wise from each other. The end closest to the cellists chair of the first member 19 contains a width-wise notch 25 on the top surface. The notch 25 is preferably one inch wide, a quarter inch deep and extends across the top surface of the first member 19 approximately three-quarters of an inch from the end opposite the end containing the holes.

The second member 21 of the T-bar structure is depicted in FIG. 5 (A and B). The second member 21 is preferably one-inch wide and three-quarters of an inch thick; its length can vary but should be longer than the distance between the front legs of chairs commonly used by the cellist. The second member 21 contains three or more crosswise notches 27 located on the underside or bottom of the member. Preferably, one notch 27 is located directly in the middle of the member between the two ends, and each of the other notches 27 are located at equal selected distances from the middle notch. The notches 27 along the underside of the second member should be two-inches wide and a quarter of an inch deep.

With these dimensions each of the notches 27 of the second member 21 interfits with the notch 25 on the first member 19 such that a T-bar shaped structure is formed. However, the notches 25 and 27 may be differently sized and only need to be complementary in size so that the first and second members 19 and 21 respectively of the T-bar section can be fitted together without excessive looseness. The pairs of holes 23 in the first member 19 are sized and positioned to allow the mounting dowels 17 located on the bottom surface of the lower plate 11 to be inserted in a selected pair.

The adjustable first and second members 19 and 21 respectively can also be provided with anti-slip rubber feet on their undersides to further prevent the resonating platform from slipping. The height of the resonating platform is adjusted according to the raised height of the T-bar.

Although particular dimensions for the upper and lower plates 7 and 11 respectively and first and second members 19 and 21 respectively of the T-bar have been provided, the invention may be embodied in a variety of different dimensions not limited to those described above. For example, the notches 25 and 27 may be of any dimension which allows the notch on the first member 19 to interface with the notch on the second member 21 and the height of the rubber or plastic bumpers and thickness of the T-bar members need only be coordinated so that the first member 19 structure can be received between the lower plate 11 of the portable platform and the floor.

Figure 6:
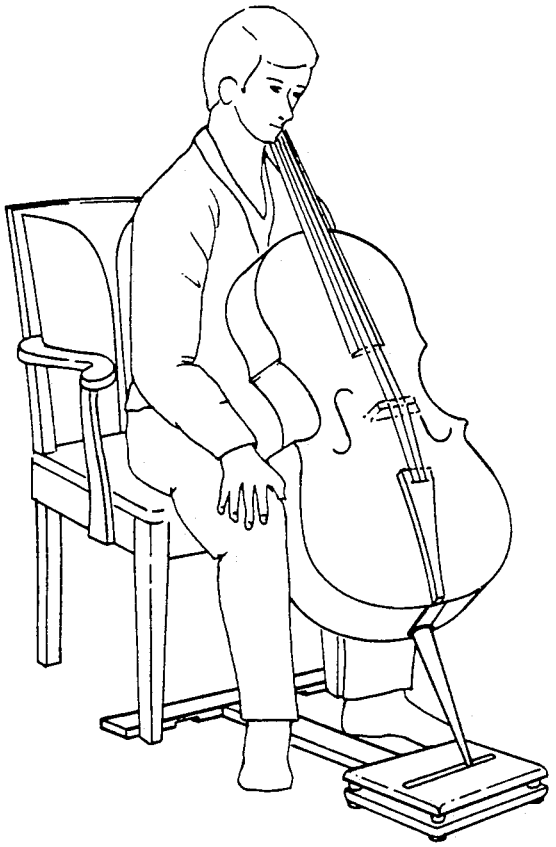
FIG. 6 is a pictorial view of the embodiment showing how it is used.

The end of the first member 19, which has the notch 25, is placed between the front pair of legs of the chair to be used by the cello player (FIG. 6). The second member 21 of the adjustable T-bar is then placed between the front pair and rear pair of the chair legs such that it extends side to side substantially perpendicular to the first T-bar member and rests against the inside of the front chair legs. The notch 25 of the first member 19 can be interfaced with any of the notches 27 on the second member 21 to create a structure for preventing the resonating platform from sliding and to fit the desire of the cellist in respect of the lateral position of the cello. Therefore, the resonating platform can be adapted for use by cello players who prefer to place the cello more toward the center of their body or on the left or right side.

The first member 19 of the T-bar is connected to the underside of the lower plate 11 by inserting the pair of mounting dowels 17 into a selected pair of holes 23 located along the top side of the first member 19. The cellist can adjust the distance that the resonating platform is placed from the chair by inserting the mounting dowels 17 on the lower plate 11 into different pairs of holes 23. To place the resonating platform furthest away from the chair the dowels 17 should be inserted into the holes 23 closest to the end of the first member 19 furthest from the notch 25 and conversely, to place the resonating platform closer to the chair the dowels 17 should be inserted into the holes 23 nearest to the notch 25 thereby effectively shortening the length of the first member 19. Therefore to accommodate short or tall cello players and allow players to set the instrument at different angles, the resonating platform can be placed at different distances from the front of the chair.

Once the cellist has placed the resonating platform at its most desired position on the floor in front of the chair, the endpin of the cello is placed within the groove 9 of the upper wooden plate 7. As the cello is played while the endpin is within the groove 9, the tone of the cello is enhanced by the vibration of the pair of plates 7 and 11. The endpin of the cello can easily be moved into different positions along the groove 9 during a concert, thereby enabling the cellist to more comfortably play the cello without sacrificing the quality of tone enhancement and without slippage of the cello.

It is evident that the invention may be embodied in a variety of ways differing from those described herein, but without departing from the scope of the invention. As previously mentioned, the dimensions of the particular structures may be varied and the types of wood used for the plates 7 and 11 may also be varied. Since many other modifications which do not depart from the spirit of the invention can easily be made, any such embodiments are intended to be included within the scope of the invention as defined by the appended claims.

I claim:

1. A portable resonating platform for enhancing the tone of a cello comprising:

a lower spruce plate;

an upper maple plate having an elongated narrow groove extending transversely along its upper surface, the groove being adapted to receive the endpin of a cello in any position along its length;

means for rigidly joining the upper and lower plates together in spaced-apart relation; and means for preventing the plates from sliding when positioned on a surface.

2. A portable resonating platform according to claim 1 wherein the means for spacing the upper and lower plates comprises a multiplicity of spaced-apart dowels securely joined to each of the plates.

3. A portable resonating platform according to claim 2 wherein the means for preventing the plates from sliding includes a multiplicity of spaced-apart slip-resistant feet attached to the lower surface of the lower plate.

4. A portable resonating platform according to claim 3 where the means for preventing the plates from sliding further includes an adjustable T-bar structure adapted to be engaged with both front legs of a chair and adjustably connected to the lower plate.

5. A portable resonating platform according to claim 4 wherein the lower plate has a pair of attachment pins projecting from its bottom surface and the adjustable T-bar structure includes a first member having a notch at one end and a plurality of pairs of holes at the opposite end for receiving the attachment pins on the lower plate, a second member having a notch therein adapted and sized to coincide with the notch of the first member such that said first and second members are connected in a substantially perpendicular relation, whereby the first member can be joined to the lower plate in any of a multiplicity of positions by inserting the attachment pins within any selected pair of holes in the first member, and the second member is positioned behind the legs of a chair to secure the T-bar structure to the chair.

6. A portable resonating platform according to claim 5 wherein the second member of the T-bar contains a plurality of notches therein for coinciding with the first member in multiple positions, thereby allowing the platform to be placed in a variety of different lateral positions relative to the legs of a chair.

7. A portable resonating platform according to claim 1 wherein the upper wooden plate is made of plain maple.

8. A portable resonating platform according to claim 1 wherein the upper wooden plate is made of flamed maple.

* * * * *